US009157294B2

(12) United States Patent
Kleppa et al.

(10) Patent No.: US 9,157,294 B2
(45) Date of Patent: Oct. 13, 2015

(54) WAVE-INDUCING DEVICE, CASING SYSTEM AND METHOD FOR CEMENTING A CASING IN A BOREHOLE

(75) Inventors: Erling Kleppa, Jørpeland (NO); Kristian Harestad, Randaberg (NO)

(73) Assignee: Perigon Handel AS, Randaberg (NO)

( * ) Notice: Subject to any disclaimer, the term of this patent is extended or adjusted under 35 U.S.C. 154(b) by 56 days.

(21) Appl. No.: 14/241,095

(22) PCT Filed: Mar. 16, 2012

(86) PCT No.: PCT/IB2012/051273

§ 371 (c)(1), (2), (4) Date: May 6, 2014

(87) PCT Pub. No.: WO2013/030681

PCT Pub. Date: Mar. 7, 2013

(65) Prior Publication Data

US 2014/0299320 A1 Oct. 9, 2014

(30) Foreign Application Priority Data

Aug. 31, 2011 (NO) ..... 20111188

(51) Int. Cl.

| | |
|---|---|
| ***E21B 33/14*** | (2006.01) |
| ***E21B 28/00*** | (2006.01) |
| ***E21B 33/13*** | (2006.01) |

(52) U.S. Cl.

CPC ..... *E21B 33/14* (2013.01); *E21B 28/00* (2013.01); *E21B 33/13* (2013.01)

(58) Field of Classification Search

CPC ..... E21B 28/00; E21B 17/1028; E21B 33/14

See application file for complete search history.

(56) References Cited

U.S. PATENT DOCUMENTS

| | | | |
|---|---|---|---|
| 3,335,801 | A | 8/1967 | Wilsey |
| 4,058,163 | A | 11/1977 | Yandell |
| 5,152,342 | A | 10/1992 | Rankin et al. |
| 2004/0159464 | A1 | 8/2004 | von Gynz-Rekowski |

FOREIGN PATENT DOCUMENTS

| | | | |
|---|---|---|---|
| EP | 0 131 451 | A2 | 1/1985 |
| EP | 0 747 571 | A2 | 12/1996 |
| SU | 1176064 | A | 8/1985 |

OTHER PUBLICATIONS

International Search Report for corresponding International Application No. PCT/IB2012/051273, mailed Jun. 24, 2013 (4 pages).

Written Opinion for corresponding International Application No. PCT/IB2012/051273, mailed Jun. 24, 2013 (10 pages).

International Preliminary Report on Patentability for corresponding International Application No. PCT/IB2012/051273, mailed Nov. 6, 2013 (12 pages).

Search Report for corresponding Norwegian Application No. 20111188, dated Mar. 29, 2012 (2 pages).

*Primary Examiner* — Zakiya W Bates

(74) *Attorney, Agent, or Firm* — Osha Liang LLP

(57) ABSTRACT

A wave-inducing device for cementing a casing in a borehole. The wave-inducing device is designed for arrangement in the casing and includes a movable element which, when the wave-inducing device is arranged in the casing, is designed to be moved by cement and/or another fluid flowing through the casing so that wave motions and/or vibrations are provided in the cement during the cementing of the casing.

6 Claims, 3 Drawing Sheets

WAVE-INDUCING DEVICE, CASING SYSTEM AND METHOD FOR CEMENTING A CASING IN A BOREHOLE

CROSS-REFERENCE TO RELATED APPLICATIONS

This application is a National Stage application of International Patent Application No. PCT/IB2012/051273, filed on Mar. 16, 2012, which claims priority to Norwegian Patent Application No. 20111188, filed on Aug. 31, 2011. The priority applications are hereby incorporated by reference in their entirety.

The present invention relates to a wave-inducing device, a casing system, a method for cementing a casing and uses of the wave-inducing device, the casing system and the method for use in cementing a casing in a hydrocarbon well.

When a well is drilled, so-called casings are installed at certain depths in the well, depending on pressure and the state of the borehole formations. The casing is used to stabilise and isolate formations from each other and also to avoid outflow to the surface. Sometimes this casing is installed after a new formation has been penetrated and, for example, 10-15 meters of new formation have been drilled. The casing is then cemented to the formation in the borehole. It is important that a new formation that is drilled is well isolated from the overlying formations with cement.

In connection with cementing or another form of isolation of one lower casing, a poor cementing job is often encountered in that the cement does not stick sufficiently well to the casing or formation in which the casing is located.

When the casing is cemented to the ground, cement slurry is pumped down inside the casing and comes out of the pipe at the bottom and is then pumped up into the annulus between the casing and the formation. As the volume of cement that is pumped is limited, the cement is subjected to contamination (mixing) by the liquids, usually drilling fluids, which are pumped ahead of and after the cement. A mixing of other liquids in the cement reduces the quality of the set cement and several things are done to avoid or reduce such mixing.

Different methods have been used to ensure that the cement job seals in a satisfactory way. These methods may, for example, consist of procedures for pumping velocity and a type of chemicals and substances which are pumped down.

The object of the present invention has therefore been to arrive at a device and a method which ensure a satisfactory cementing of casings in a borehole.

It is also an object of the present invention to provide a simple device and method capable of ensuring that the cement sticks or bonds to the casing and the formation around the casing during the cementing of the casing.

It is also an object of the present invention that the cementing of the casing should be capable of being carried out without further control from the surface being necessary after the cementing job has been done.

These objects are achieved by means of a wave-inducing device as defined in independent claim 1, a casing system as defined in independent claim 8, a method for cementing a casing as defined in claim 17 and uses of the wave-inducing device, casing system and method as defined in claims 21-23. Additional embodiments of the invention are disclosed in the dependent claims.

The present invention ensures that the cementing job is done in a satisfactory way in that it sets cement and casing in wave motion or in vibration. There is preferably used a wave-inducing device or a vibrator device that is arranged in the casing. The wave-inducing device is supplied with energy from the cement or the medium that is pumped down through the casing, for example, in that the wave-inducing device is provided with an impeller. The energy that is taken from the cement or the fluid flowing through the casing causes the impeller to rotate. The waves and the vibrations arise either as a result of the impeller itself producing waves and/or vibrations or in that elements connected to the impeller produce this energy.

The present invention thus comprises a wave-inducing device and a casing system comprising a casing, for ensuring that cement sticks to the formation and casing when cementing the casing in a borehole. The wave-inducing device is designed to be arranged in the casing and to be moved by cement and/or another fluid which flows through the casing so that wave motions and/or vibrations are provided in the cement during cementing of the casing. To provide wave motions and/or vibration, the wave-inducing device comprises a movable element which, when the wave-inducing device is arranged in the casing, is moved by the cement, or optionally other fluids, flowing through the casing.

As mentioned above, the movable element may comprise a rotating wheel with a mass that is eccentrically or asymmetrically distributed about the rotational axis of the rotating wheel so that the rotating wheel is unstable when it rotates and provides wave motions and/or vibrations in the casing which propagate to the cement in the annulus between the casing and the borehole formations. Other alternative movable elements which do not rotate, but which are nevertheless capable of providing wave motions or vibrations in the cement, are also conceivable. These may, for example, be elongate elements that are arranged inside the casing and which are, actuated by the cement flowing through the casing such that wave motions or vibrations occur in the cement.

The rotating wheel may preferably be configured with a through hole in the direction of its rotational axis. The through hole is preferably circular, but may of course be given another shape if so desired.

In order to make the rotating wheel rotate, the rotating wheel is preferably provided with at least one impeller blade, vanes, wings or similar devices. The at least one impeller blade is preferably arranged in the through hole, but may also be arranged on the radial outer edge of the rotating wheel if this is desirable. When cement or possibly another fluid flows through the casing and past the at least one impeller blade, the rotating wheel will thus be rotated by the cement or fluid that flows by. The energy needed to provide the wave motions/vibrations in the cement is taken from the cement that is in any case pumped down. Thus, a wave-inducing device is provided which functions without it being necessary to have supply of additional energy through, for example, electric cables or hydraulic lines.

The rotating wheel may also be provided with extra mass distributed around it in such a way that the rotating wheel becomes unstable as it rotates. In an embodiment of the invention, this is done in that at least one of the blades is provided with a weight element or is configured with a larger mass than the other blades such that the rotating wheel becomes unstable as it rotates.

In an embodiment of the invention, the wave-inducing device comprises at least one beater device that is movably arranged on the rotating wheel or alternatively on the casing and is adapted such that the beater device beats, preferably against the casing, as the rotating wheel rotates. The at least one beater device is preferably spring-loaded. For example, the beater device may comprise a spring device which seeks to move the at least one beater device towards the idle position of the at least one beater device in which it rests against the casing. The rotating wheel or casing may further comprise at least one striking element which is so arranged that the at least one striking element strikes the at least one beater device as the rotating wheel rotates. When the beater device is tilted out and subsequently beats against the casing, vibrations are produced in the casing, which propagate to the cement that is in the annulus between the casing and the borehole formations.

The present invention also comprises a method for ensuring that cement sticks to the formation and casing during the cementing of a casing in a borehole in that at least one wave-inducing device is arranged in the casing before the casing is arranged in the borehole or after the casing has been arranged in the borehole and that cement and/or a fluid is pumped down through the casing and drives the at least one wave-inducing device such that the at least one wave-inducing device provides wave motions and/or vibrations in the cement that is located between the casing and the borehole formations.

In a preferred embodiment, the energy necessary to operate the wave-inducing device is taken from the cement or the fluid flowing through the casing. As mentioned above, there is thus no need for electric cables and/or hydraulic lines for supply of energy to operate the wave-inducing device.

The wave motions and/or vibrations in the cement may, in an embodiment of the invention, be provided by an unbalanced rotating wheel, for example, a rotating wheel with a mass that is eccentrically or asymmetrically arranged about the rotational axis of the rotating wheel. Alternatively, the wave motions and/or vibrations can be provided by a beater device that is adapted to beat on the casing or on the rotating wheel as described in more detail above.

In a preferred embodiment of the invention, the wave-inducing device is made of a drillable material. After the job has been done, the wave-inducing device may then be drilled out of the casing using standard drilling equipment, which will often be desirable.

A use of the wave-inducing device as described above is in connection with the cementing of a casing in a hydrocarbon well.

A use of a casing system as described above is in connection with the cementing of a casing in a hydrocarbon well.

A use of a method for cementing a casing as described above is in connection with the cementing of a casing in a hydrocarbon well.

Two non-limiting embodiments of the present invention will be described below with reference to the figures, wherein.

Figure 1:
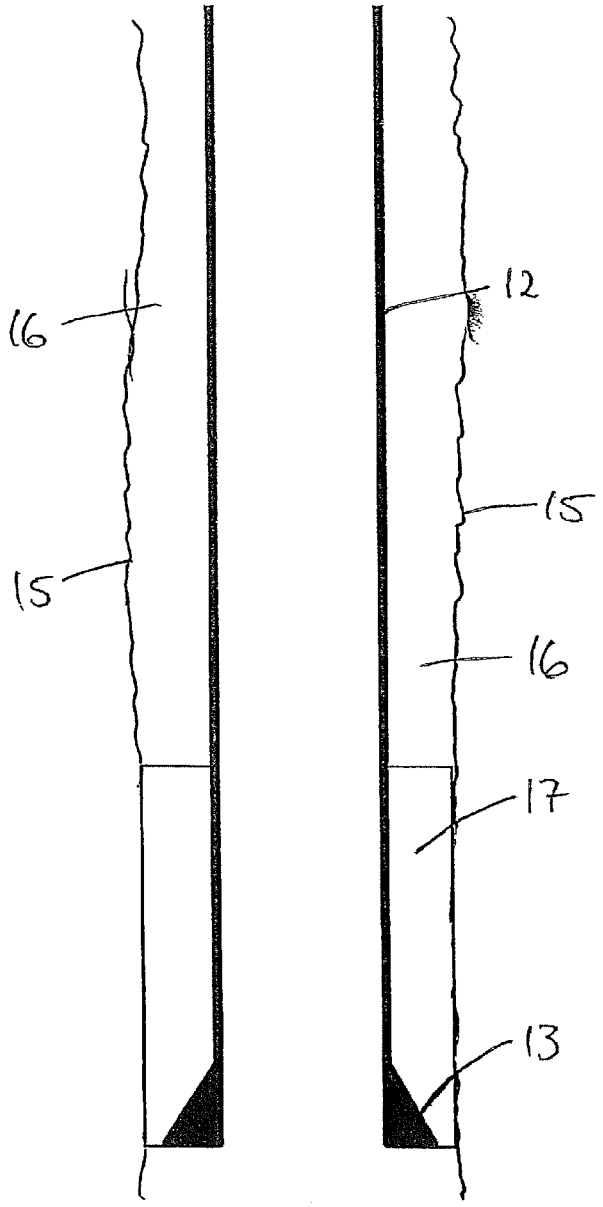
FIG. 1 shows a casing that has been placed in a borehole.

FIG. 1 is a schematic illustration of a casing 12 that has been placed in a borehole where the borehole formations 15 around the casing 12 are indicated. Between the formations 15 and the casing 12 there is formed an annulus 15 that is filled with cement some way up from the lowermost end of the casing 12 at the casing shoe 13 when the casing is cemented.

Figure 2:
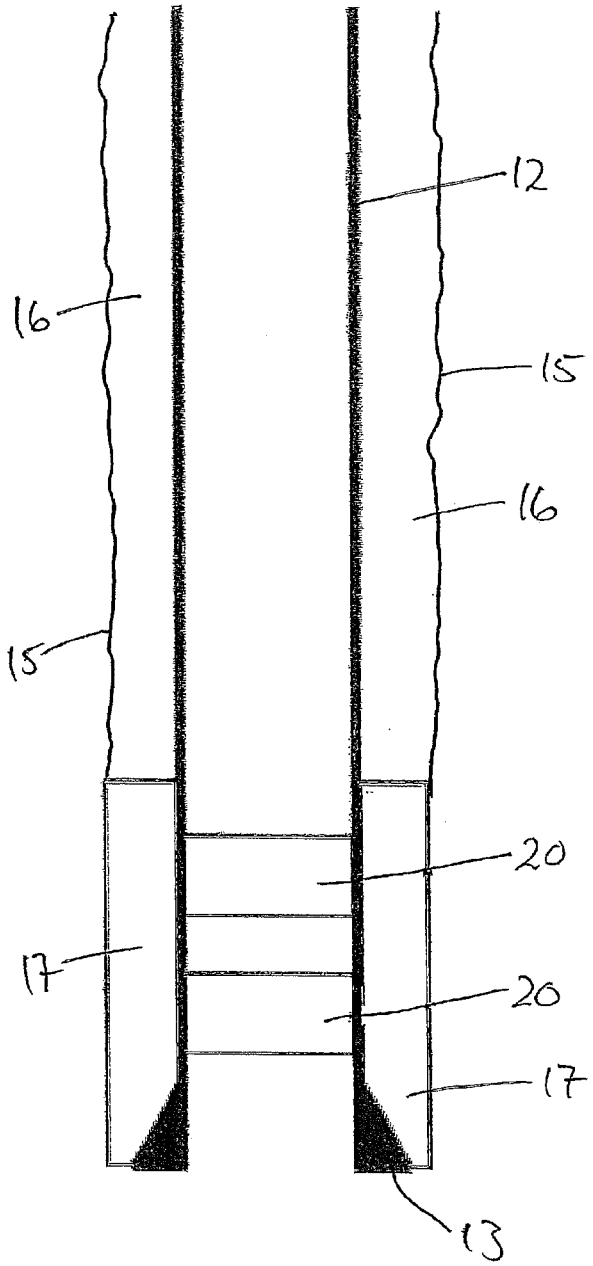
FIG. 2 shows the casing in FIG. 1 provided with wave-inducing devices.

During the cementing of the casing 12, cement is pumped down through the casing 12. At the bottom of the casing, the cement 17 is forced up into the annulus 16 as shown in FIGS. 1 and 2. It is important that the cement 17 bonds or sticks well to the casing 12 and the formations 15 so that the job does not need doing again, which is both costly and time-consuming.

To ensure that the cementing job is good, the casing 12 is therefore provided with one or more wave-inducing devices 20 as shown in FIG. 2. The wave-inducing device 20 is designed so that when cement is pumped down through the casing, the energy in the cement will be utilised to drive the wave-inducing device 20 that is designed to provide wave motions or vibrations in the cement 17 that is in the annulus 16 between the casing 12 and the borehole formations 15. The wave motions or vibrations in the cement 17 help the cement to set better and contribute to a better bonding of the cement 17 to the casing 12 and formations 15 after the cementing process is completed.

Figure 3:
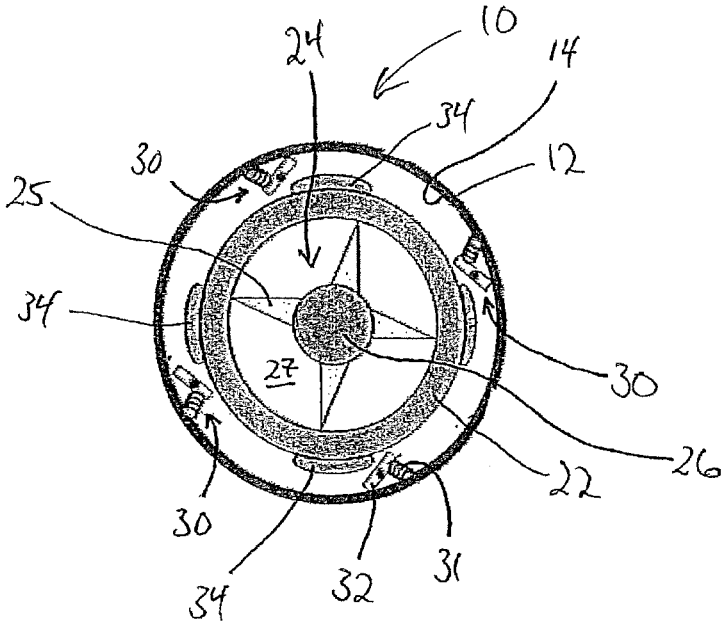
FIG. 3 shows a cross-section through a first embodiment of a casing system equipped with a wave-inducing device.
Figure 4:
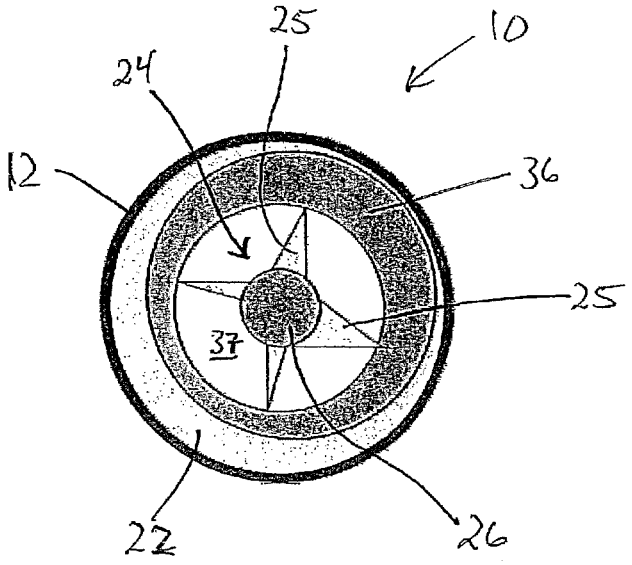
FIG. 4 shows a cross-section through a second embodiment of a casing system equipped with a wave-inducing device.

FIGS. 3 and 4 show respectively a first and a second embodiment of the casing system 10 equipped with a wave-inducing device 20 according to the present invention. The wave-inducing device 20 is arranged in the casing 12 and comprises a rotating wheel 22. The rotating wheel is preferably supported in a bearing inside the casing 12 such that it can rotate about a rotational axis which preferably is essentially parallel to the longitudinal central axis of the casing 12.

The rotating wheel 22 that is shown in the embodiment in FIG. 3 is configured with an axially through-going opening 27 through which cement can flow when the casing 12 is to be cemented to the formations 15. Arranged in the through-going opening 27 is an impeller 24 comprising a plurality of impeller blades 25. In FIG. 3, the impeller 24 is shown provided with four impeller blades, but it is of course possible to provide the impeller with a different number of blades 25, if so desired. The impeller blades 25 are preferably attached to a central element or hub 26 at one radial end and to the rotating wheel 22 at the other radial end as shown in FIG. 3.

The casing device 12, as shown in FIG. 3, is further provided with a plurality of beater devices 30 which preferably are fastened to the casing 12. However, it is also conceivable that the beater devices may be fastened to the rotating wheel 22.

The beater devices 30 comprise at least one spring device 31 which preferably is fastened to the casing 12 as mentioned above. Attached to the spring device 31 is a beater element 32 which preferably rests against the inside wall 14 of the casing 12 in an idle position, i.e., when the spring device 31 of the beater 30 is not subjected to forces that force the beater element 31 out from the inner wall 14. The spring device 31 may comprise a torsion spring or other suitable types of springs.

The rotating wheel 22 is preferably provided with a plurality of striking elements 34 around its outer periphery. As the rotating wheel 22 is rotated by the cement flowing through the casing 12 and the through opening 27, the striking elements 34 will strike the beater devices 30 and tilt the beater elements 32 out from the inner wall 14 against which they will normally rest. When a striking element 34 has passed a beater device 30, the beater element 32 is forced against the inner wall 14 of the casing 12 by the action of the spring device 31 and strikes the inner wall 14 so that the casing vibrates. These vibration motions are transmitted to the cement that is located in the annulus 16 on the outside of the casing 12.

FIG. 3 shows four beater devices 30 and four striking elements 34. This number may however be varied according to need. It should also be mentioned that just above and optionally just below the beater devices 30, the rotating wheel may be configured so that it seals against the inner wall 14 of the casing 12 such that the cement is forced to flow through the through opening 27. This means that the cement does not affect the effectiveness of the beater devices 30.

A second embodiment of the wave-inducing device 20 is shown in FIG. 4. Here too, the rotating wheel is provided with a through opening 37 through which the cement can flow In the through opening 37 there is preferably arranged an impeller 24 with a plurality of impeller blades 25. The impeller blades 25 are preferably attached to the rotating wheel 22 and to a hub or a central element 26.

In this embodiment of the wave-inducing device 20, the rotating wheel 22 is provided with a mass that is eccentrically or asymmetrically arranged in relation to the rotational axis of the rotating wheel 22. Such a mass can be configured in many different ways. FIG. 4 shows a substantially circular weight element 36 which may be attached to the rotating wheel 22 or may be an integral part of the rotating wheel 22. The weight element 36 is eccentrically arranged in relation to the rotational axis of the rotating wheel 22. When the rotating wheel 22 is rotated by the cement that flows through the through opening 37, the eccentricity of the weight element 36, and thus the rotating wheel 22, will cause the casing 12 to swing out in a radial direction in relation to the normal position of the casing 12. This wave motion is naturally transmitted to the cement 17 in the annulus 16 between the casing 12 and the borehole formations 15 such that cement 17 sets better.

The invention claimed is:

1. A wave-inducing device for cementing a casing in a borehole, wherein the wave-inducing device is designed for arrangement in the casing and comprises:

a movable element which, when the wave-inducing device is arranged in the casing, is designed to be moved by cement and/or another fluid flowing through the casing so that wave motions and/or vibrations are provided in the cement during the cementing of the casing, the movable element comprising:

a rotating wheel with a rotational axis and a through hole in a direction of the rotational axis for through flow of cement, wherein at least one impeller is arranged in the through hole, wherein the rotating wheel is further provided with a mass that is eccentrically or asymmetrically arranged in relation to the rotational axis causing the casing to swing out in a radial direction in relation to a normal position of the casing when the wheel is rotated.

2. A casing system for cementing a casing in a borehole, the casing system comprising:

a casing; and a wave-inducing device according to claim 1, the wave-inducing device being arranged in the casing.

3. Use of a casing system according to claim 2 for cementing of a casing in a hydrocarbon well.

4. Use of a wave-inducing device according to claim 1 for cementing of a casing in a hydrocarbon well.

5. A method for ensuring that cement sticks to formation and casing when cementing a casing in a borehole, wherein:

at least one wave-inducing device is arranged in the casing before the casing is arranged in the borehole or after the casing has been arranged in the borehole;

the at least one wave-inducing device comprising a movable element comprising a rotating wheel with a rotational axis and a through hole in the direction of the rotational axis for through flow of cement, wherein at least one impeller is arranged in the through hole;

the rotating wheel further being provided with a mass that is eccentrically or asymmetrically arranged in relation to the rotational axis causing the casing to swing out in a radial direction in relation to the normal position of the casing when the wheel is rotated, wherein cement and/or a fluid is pumped down through the casing thereby driving the at least one wave-inducing device so that the at least one wave-inducing device provides wave motions and/or vibrations in the cement that is located between the casing and the formation.

6. Use of a method for ensuring that cement sticks to formation and casing when cementing a casing in a borehole according to claim 5 for cementing a casing in a hydrocarbon well.

* * * * *